US007911390B2

(12) United States Patent
Chiu

(10) Patent No.: US 7,911,390 B2
(45) Date of Patent: Mar. 22, 2011

(54) ANTENNA STRUCTURE

(75) Inventor: Yi-Hung Chiu, Taipei Hsien (TW)

(73) Assignee: Wistron NeWeb Corporation, Hsi-Chih, Taipei Hsien (TW)

( * ) Notice: Subject to any disclaimer, the term of this patent is extended or adjusted under 35 U.S.C. 154(b) by 341 days.

(21) Appl. No.: 12/099,787

(22) Filed: Apr. 9, 2008

(65) Prior Publication Data

US 2009/0179800 A1 Jul. 16, 2009

(30) Foreign Application Priority Data

Jan. 15, 2008 (TW) ..... 97101505 A

(51) Int. Cl.
*H01Q 1/38* (2006.01)
*H01Q 1/24* (2006.01)

(52) U.S. Cl. ..... 343/700 MS; 343/702; 343/830; 343/829; 343/846

(58) Field of Classification Search ..... None
See application file for complete search history.

(56) References Cited

U.S. PATENT DOCUMENTS

| | | | | |
|---|---|---|---|---|
| 6,812,892 | B2 * | 11/2004 | Tai et al. | 343/700 MS |
| 6,850,197 | B2 * | 2/2005 | Paun | 343/702 |
| 6,950,068 | B2 * | 9/2005 | Bordi et al. | 343/702 |
| 7,075,484 | B2 * | 7/2006 | Sung | 343/700 MS |
| 7,333,067 | B2 * | 2/2008 | Hung et al. | 343/770 |
| 7,535,422 | B2 * | 5/2009 | Liu et al. | 343/702 |
| 7,541,984 | B2 * | 6/2009 | Peng et al. | 343/700 MS |
| 7,675,463 | B2 * | 3/2010 | Wallace et al. | 343/700 MS |

* cited by examiner

*Primary Examiner* — Trinh V Dinh
(74) *Attorney, Agent, or Firm* — Winston Hsu; Scott Margo

(57) ABSTRACT

An antenna structure includes a radiation element, a grounding element, a short point, and a feeding point. The radiation element includes a first radiator and a second radiator. The second radiator partially surrounds the first radiator and there is a predetermined distance included between the first radiator and the second radiator for matching impedance. The short point is coupled between the second radiator and the grounding element. The feeding point is coupled between a joint point of the first radiator and the second radiator and the grounding element.

20 Claims, 13 Drawing Sheets

| Frequency | Maximum value | Position | Minimum value | Position | Beam-width | Average value |
|---|---|---|---|---|---|---|
| 3168(MHz) | 1.76dB | 294.00deg | -16.55dB | 105.00deg | 78.17deg | -3.37dB |
| 3432(MHz) | 1.29dB | 285.00deg | -7.79dB | 126.00deg | 33.58deg | -2.69dB |
| 3696(MHz) | 2.01dB | 291.00deg | -11.27dB | 72.00deg | 32.02deg | -3.51dB |
| 3960(MHz) | 2.82dB | 291.00deg | -10.95dB | 174.00deg | 29.43deg | -2.12dB |
| 4224(MHz) | 1.57dB | 291.00deg | -7.48dB | 330.00deg | 27.23deg | -2.43dB |
| 4488(MHz) | 2.30dB | 81.00deg | -10.15dB | 327.00deg | 61.73deg | -1.61dB |
| 4752(MHz) | 2.00dB | 45.00deg | -10.37dB | 270.00deg | 48.43deg | -2.77dB |

FIG. 8

ANTENNA STRUCTURE

RELATED APPLICATIONS

The Application claims priority under 35 U.S.C. 119 to an application TAIWAN 097101505 filed Jan. 15, 2008, the contents of which are incorporated herein by reference.

BACKGROUND OF THE INVENTION

1. Field of the Invention

The present invention relates to an antenna structure, and more particularly, to an antenna structure disposing a radiator around another radiator and to make at least one predetermined distance included between the two radiators for matching impedance and for increasing bandwidth of antenna.

2. Description of the Prior Art

With the trend of micro-sized mobile communications products, the location and the space arranged for antennas becomes increasingly limited. Therefore, built-in micro antennas have been developed. Some micro antennas such as chip antennas and planar antennas are commonly used and occupy very small volume.

The planar antenna has the advantages of small size, light weight, ease of manufacturing, low cost, high reliability, and can also be attached to the surface of any object. Therefore, micro-strip antennas and printed antennas are widely used in wireless communication systems.

Due to multimedia applications of present wireless communication products, such as notebook computers, getting more and popular every day, transmissions with a large number of data has become a basic requirement of the wireless communication products. Thus requirements for operations at wide bandwidth get more basic. Therefore, how to improve antenna efficiency, adjust impedance matching, improve radiation patterns, and increase bandwidths of the antennas become important topics in this field.

SUMMARY OF THE INVENTION

It is one of the objectives of the present invention to provide an antenna structure to solve the abovementioned problems.

The present invention discloses an antenna structure. The antenna structure includes a radiation element, a grounding element, a short point, and a feeding point. The radiation element has a first radiator and a second radiator, wherein the second radiator partially surrounds the first radiator and there is a predetermined distance included between the first radiator and the second radiator for matching impedance. The short point is coupled between the second radiator and the grounding element. The feeding point is coupled between a joint point of the first radiator and the second radiator and the grounding element.

In one embodiment, the second radiator includes a plurality of sections. A designated section of the plurality of sections overlaps the first radiator and is at a first designated distance from the first radiator in a designated direction, and the designated section is at a second designated distance from the grounding element in a direction opposite to the first designated direction. There is a fillister formed between the designated section of the second radiator, the short point, and the grounding element.

In one embodiment, the antenna structure further includes a third radiator coupled to the feeding point, wherein there is a third designated distance included between the third radiator and the second radiator for matching impedance.

In one embodiment, the radiation element and the grounding element locate on different planes, and the antenna structure presents a solid form.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 8 is a table illustrating an antenna gain of the antenna structure shown in FIG. 3.

DETAILED DESCRIPTION

Figure 1:
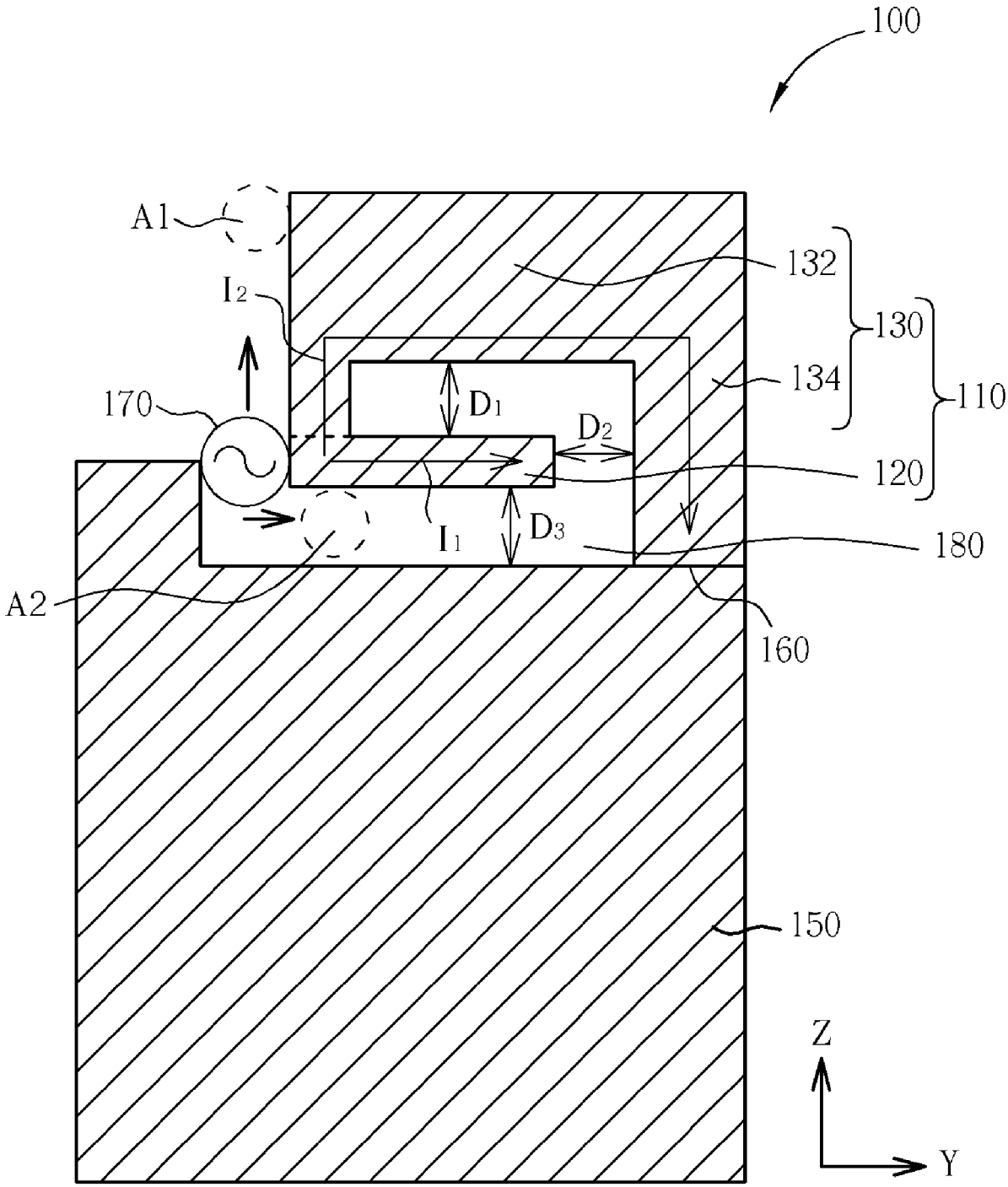
FIG. 1 is a diagram of an antenna structure according to a first embodiment of the present invention.

Please refer to FIG. 1. FIG. 1 is a diagram of an antenna structure 100 according to a first embodiment of the present invention. The antenna structure 100 includes a radiation element 110, a grounding element 150, a short point 160, and a feeding point 170. The radiation element 110 includes a first radiator 120 and a second radiator 130, and the second radiator 130 surrounds the first radiator 120. In this embodiment, the second radiator 130 includes a first section 132 and a second section 134. The first section 132 is at a designated distance $D_1$ from the first radiator 120 in a first designated direction (i.e., +Z axis). The second section 134 is at a designated distance $D_2$ from the first radiator 120 in a second designated direction (i.e., +Y axis). The first radiator 120 is at a designated distance $D_3$ from the grounding element 150 in a direction opposite to the first designated direction (i.e., −Z axis). In addition, the short point 160 is coupled between the second section 134 of the second radiator 130 and the grounding element 150. The feeding point 170 is coupled between a joint point of the first radiator 120 and the second radiator 130 and the grounding element 150. In other words, the first radiator 120, the second radiator 130, the short point 160, the grounding element 150, and the feeding point 170 are disposed around along a sealed region 180, wherein the sealed region 180 is a U type.

Please note that, the abovementioned "surround" does not mean that the second radiator 130 must completely surround the first radiator 120 but is disposed around the first radiator 120 partially.

Please keep referring to FIG. 1. A current $I_1$ flows through the first radiator 120 and a current $I_2$ flows through the second radiator 130 in the direction of the two arrows shown in FIG. 1. In this embodiment, through disposing the sections 132 and 134 of the second radiator 130 around the first radiator 120, together with a capacitor effect generated from each section of the second radiator 130 and the first radiator 120 at more than one location and a capacitor effect generated from the first radiator 120 and the grounding element 150, the impedance matching of the antenna structure 100 can be changed. Through adjusting parameters such as the designated distances $D_1$, $D_2$, and $D_3$, a goal of increasing bandwidth of antenna can be achieved.

Please note that, as mentioned above, the first radiator 120 is a slender rectangle and the second radiator 130 has an L shape, but this is not a limitation of the present invention. Those skilled in the art should appreciate that various modifications of shapes of the first radiator 120 and the second radiator 130 may be made, and further description is omitted here for brevity. In addition, the location of the feeding point 170 is not unchangeable and can be moved to anywhere between locations A1 and A2 according to the arrow indicated in FIG. 1.

In this embodiment, the first radiator 120 resonates at an operating frequency band of higher frequency, wherein a length of the first radiator 120 is approximately one-fourth of a wavelength ($\lambda/4$) of a first resonance mode generated by the antenna structure 100. The second radiator 130 resonates at an operating frequency band of lower frequency, wherein a length of the second radiator 130 is approximately one-fourth of a wavelength of a second resonance mode generated by the antenna structure 100. Furthermore, through the capacitor effect generated from the second radiator 130 and the first radiator 120 at more than one location together with the capacitor effect generated from the first radiator 120 and the grounding element 150 (i.e., the capacitor effect generated by the designated distance $D_1$, $D_2$, and $D_3$), the two resonance modes can be combined to increase the bandwidth of antenna structure 100.

Figure 2:
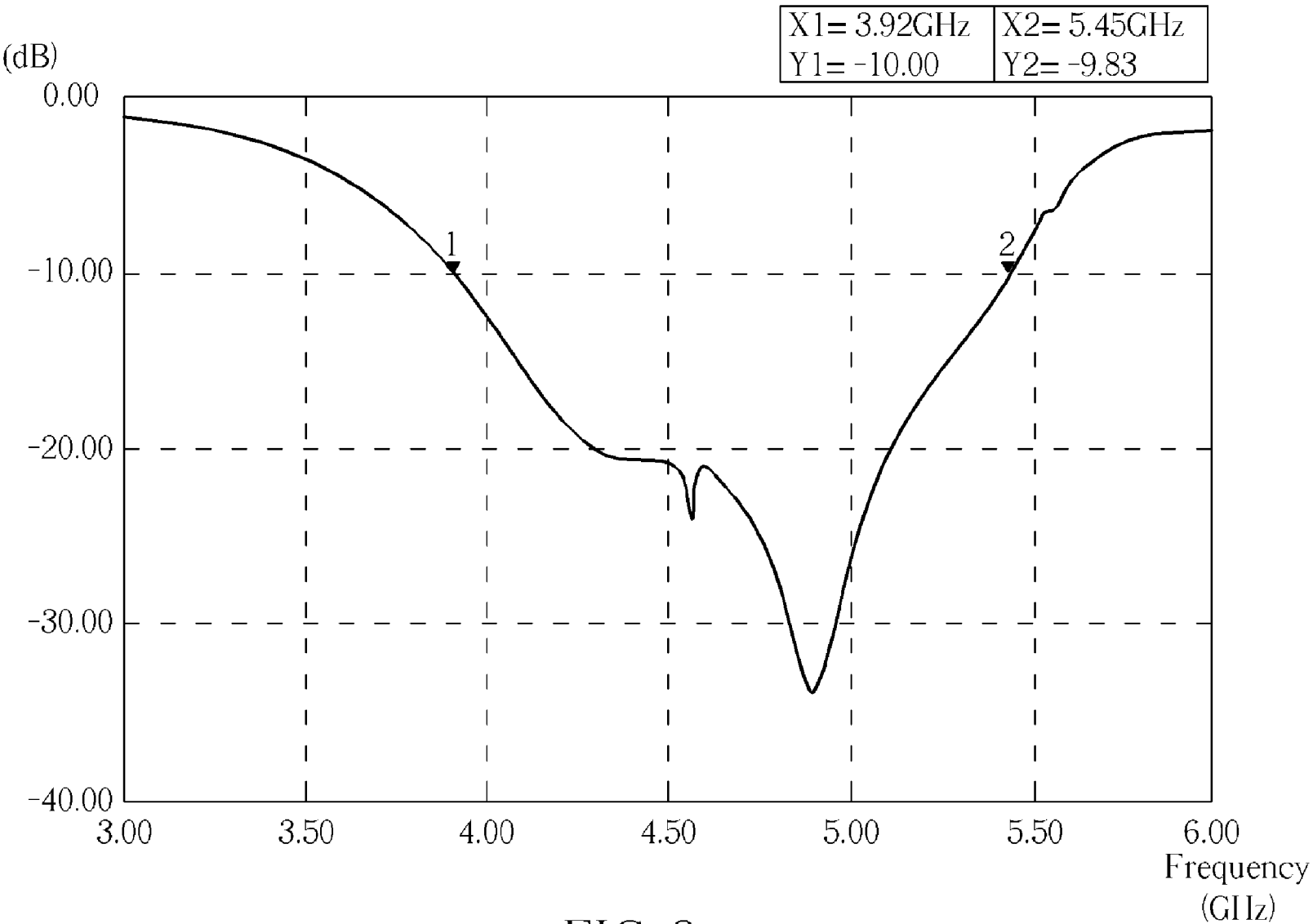
FIG. 2 is a diagram illustrating the return loss of the antenna structure shown in FIG. 1.

Please refer to FIG. 2. FIG. 2 is a diagram illustrating the return loss of the antenna structure 100 shown in FIG. 1. As shown in FIG. 2, the frequency 3.92 GHz and the return loss (−10.00 dB) of a first sign 1 and the frequency 5.45 GHz and the return loss (−9.83 dB) of a second sign 2 are marked. As is known from FIG. 2, the return loss falls below (−10 dB) for frequencies between 3.92 GHz and 5.45 GHz, which has a bandwidth approximately equaling 1.53 GHz (5.45 GHz−3.92 GHz=1.53 GHz). Thus an effective bandwidth percentage is substantially 1.53/4.685=32.65% ((5.45 GHz+3.92 GHz)÷2=4.685 GHz). Those skilled in the art should appreciate that the return loss can be transformed into the voltage standing wave ratio (VSWR) through equations, thus the return loss and the VSWR essentially have the same meaning.

Figure 3:
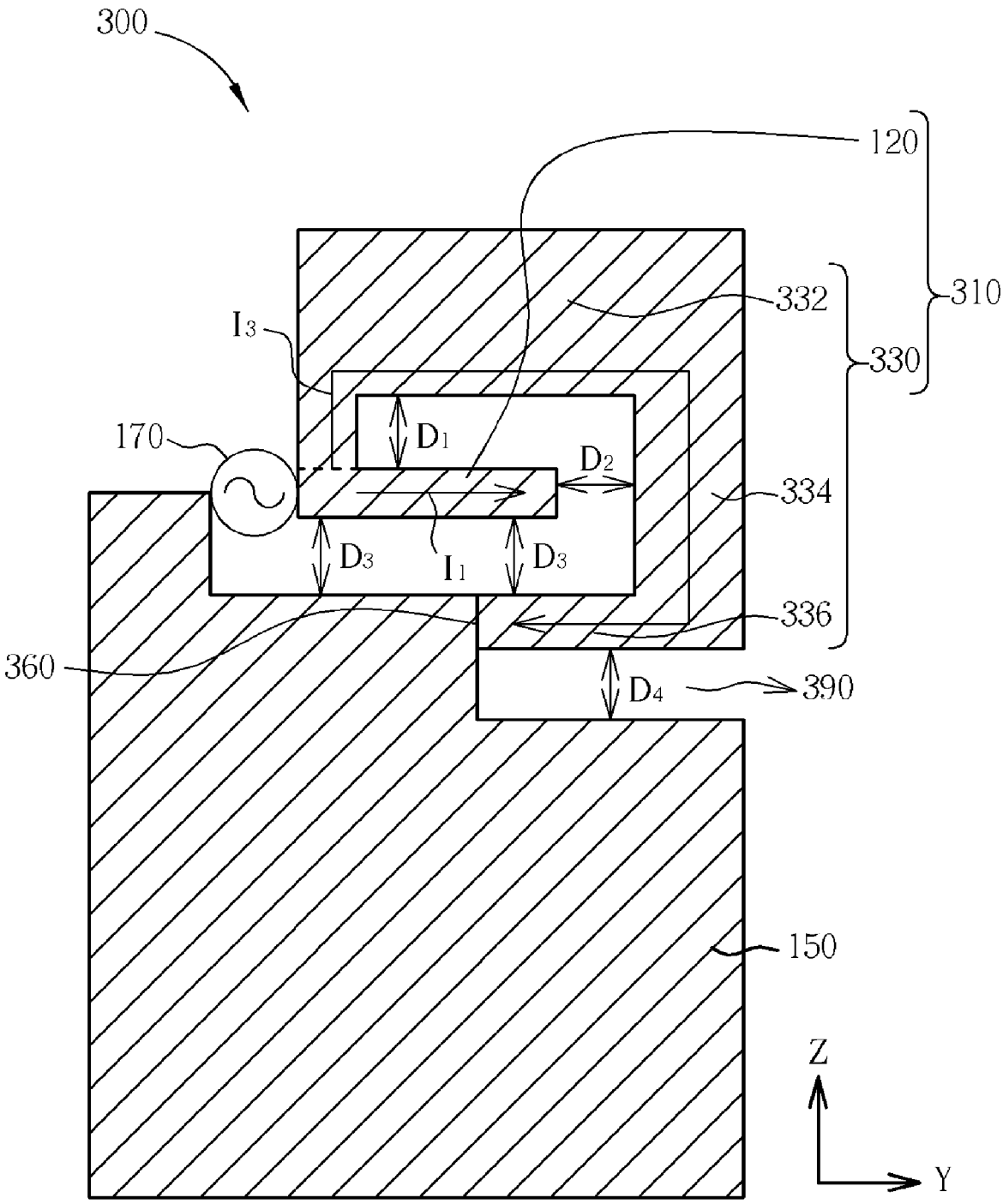
FIG. 3 is a diagram of an antenna structure according to a second embodiment of the present invention.

Please refer to FIG. 3. FIG. 3 is a diagram of an antenna structure 300 according to a second embodiment of the present invention, which is a varied embodiment of the antenna structure 100 shown in FIG. 1. In FIG. 3, the architecture of the antenna structure 300 is similar to that of the antenna structure 100, and the difference between them is described in the following. The antenna structure 300 includes a radiation element 310. A number of sections included by a second radiator 330 of the antenna structure 300 is different from that of the second radiator 130 of the antenna structure 100. In FIG. 3, the second radiator 330 includes a first section 332, a second section 334, and a third section 336, wherein the third section 336 partially overlaps the first radiator 120 and is at the designated distance $D_3$ from the first radiator 120 in the first designated direction (i.e., +Z axis), and is at a designated distance $D_4$ from grounding element 150 in the direction opposite to the first designated direction (i.e., −Z axis). There is a fillister 390 formed between the third section 336, the short point 360, and the grounding element 150 for generating capacitor effect. Furthermore, the shape and the location of the short point 360 included by the antenna structure 300 are different from that of the short point 160 in FIG. 1. Those skilled in the art should appreciate that this is not a limitation of the present invention and various modifications of the shape, size, and location of the short point may be made. For example, the short point can be implemented by the symbol 160 marked in FIG. 1 or the symbol 360 marked in FIG. 3. Or the short point can be extended from the rear end of the second radiator 330, such as the symbol 336 marked in FIG. 3 or the symbol 960 marked in FIG. 9, which should also belong to the scope of the present invention.

Please keep referring to FIG. 3. The current $I_1$ flows through the first radiator 120 and a current $I_3$ flows through the second radiator 330 in the direction of the two arrows shown in FIG. 3. In this embodiment, through disposing each section 332, 334 and 336 of the second radiator 330 around the first radiator 120, together with the capacitor effect generated from each section of the second radiator 330 and the first radiator 120 at more than one location, the capacitor effect generated from the first radiator 120 and the grounding element 150, and the capacitor effect generated from the second radiator 330 and the grounding element 150, the impedance matching of the antenna structure 300 can be changed. Through adjusting parameters such as the designated distances $D_1$, $D_2$, $D_3$, and $D_4$, a goal of increasing bandwidth of antenna can be achieved.

Figure 4:
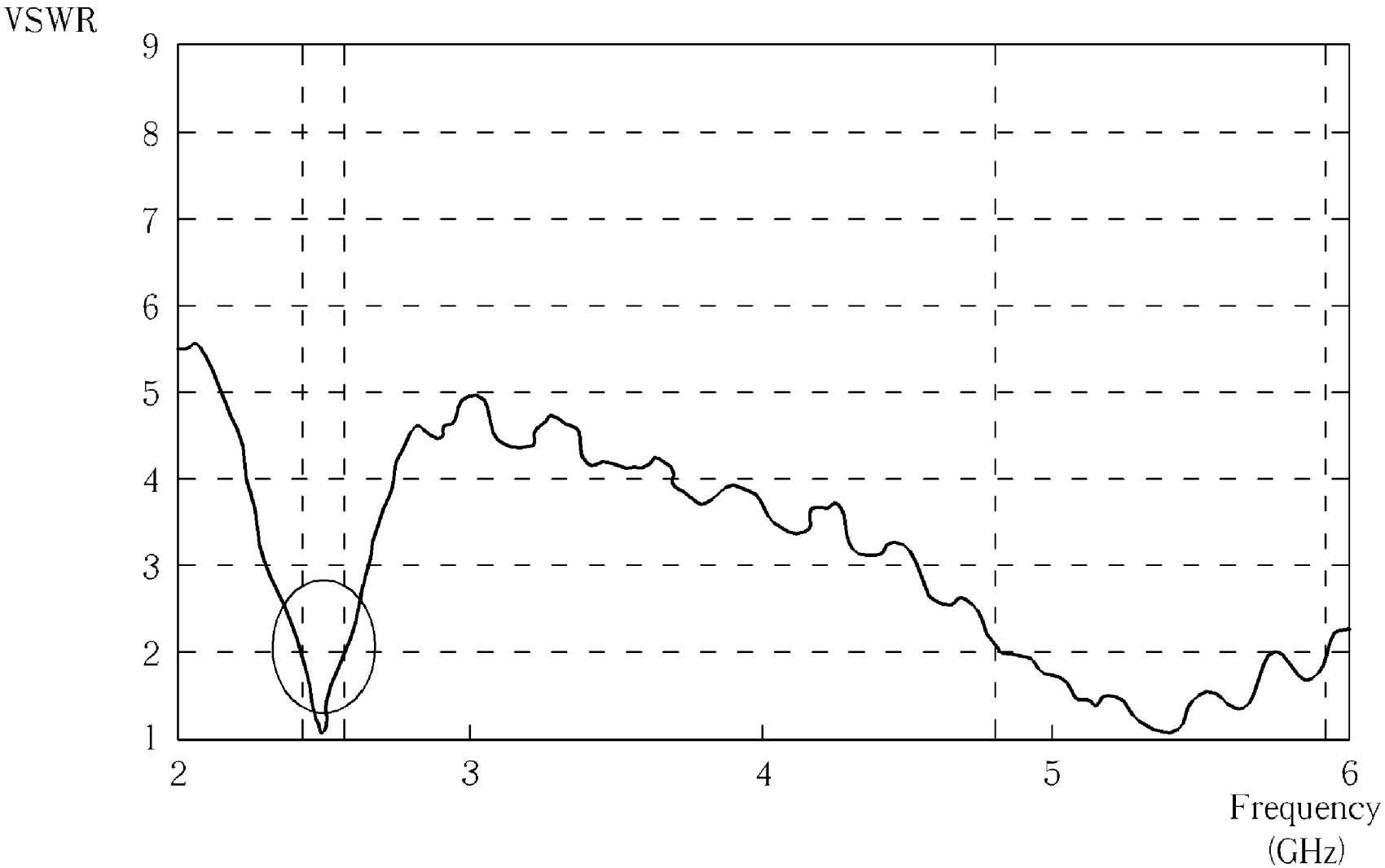
FIG. 4 is a diagram illustrating the VSWR of the conventional dual-frequency antenna.
Figure 5:
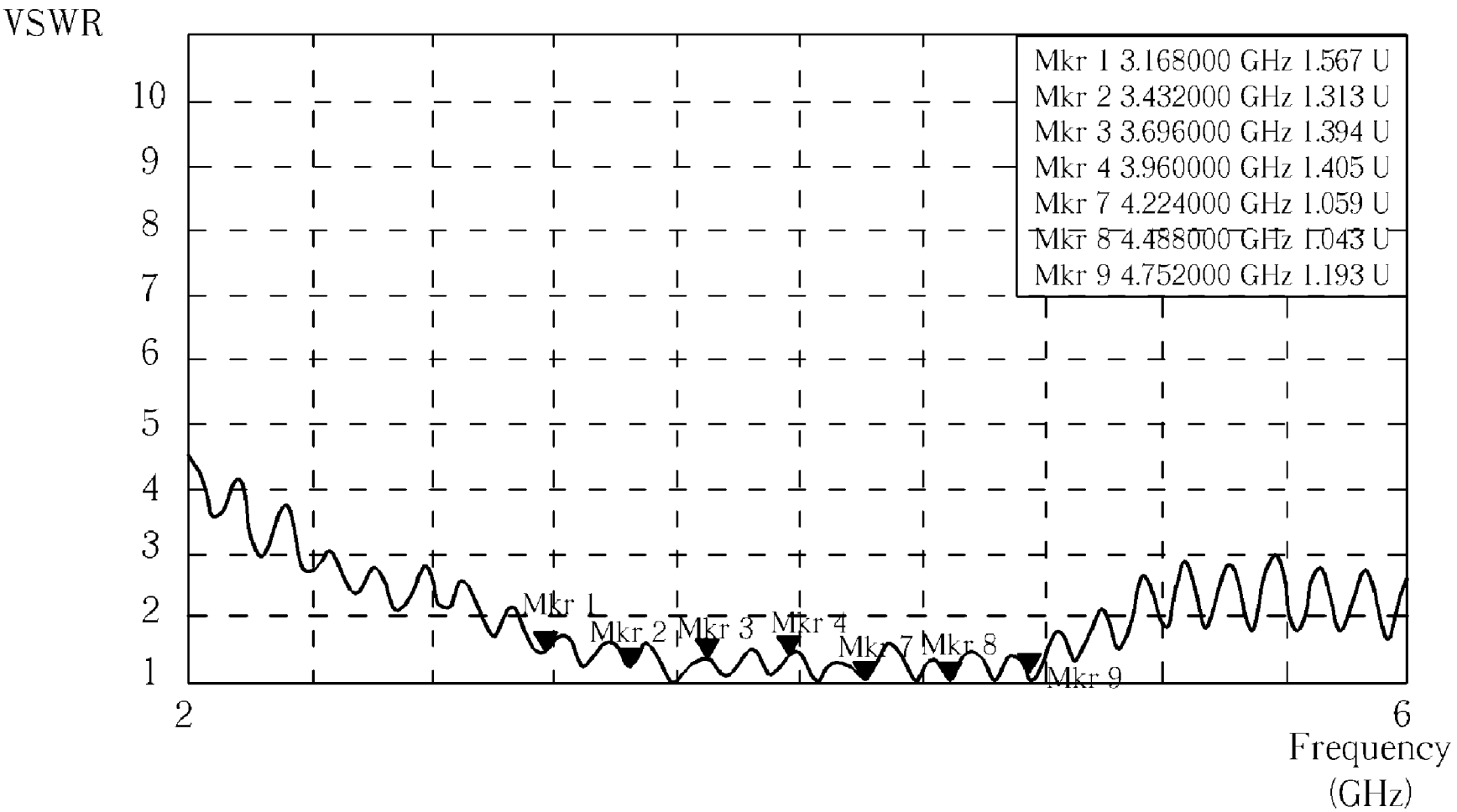
FIG. 5 is a diagram illustrating the VSWR of the antenna structure shown in FIG. 3.

In addition, a comparison of the antenna structure disclosed in the present invention with a conventional dual-frequency antenna further expands advantages of the antenna structure disclosed in the present invention. Please refer to FIG. 4 together with FIG. 5. FIG. 4 is a diagram illustrating the VSWR of the conventional dual-frequency antenna, and FIG. 5 is a diagram illustrating the VSWR of the antenna structure 300 shown in FIG. 3. The horizontal axis represents frequency (Hz), between 2 GHz and 6 GHz, and the vertical axis represents the VSWR. The conventional dual-frequency antenna mentioned herein means a planar inverted F antenna (PIFA) having two radiators, wherein the two radiators are located on different sides of the feeding point and extend in different directions. As shown in FIG. 4, there is only a bandwidth of 250 MHz having the VSWR fall below 2 near the frequency 2450 MHz. Thus an effective bandwidth percentage is substantially 250/2450=10.2%. As shown in FIG. 5, the VSWR falls below 2 for frequencies between 3.168 GHz and 4.752 GHz, which has an effective bandwidth percentage substantially equaling 1.584/3.96=40%. As can be known by comparing them, the effective bandwidth of the antenna structure 300 shown in FIG. 3 is much better than that of the conventional dual-frequency antenna (1.58 GHz>250 MHz).

Figure 6:
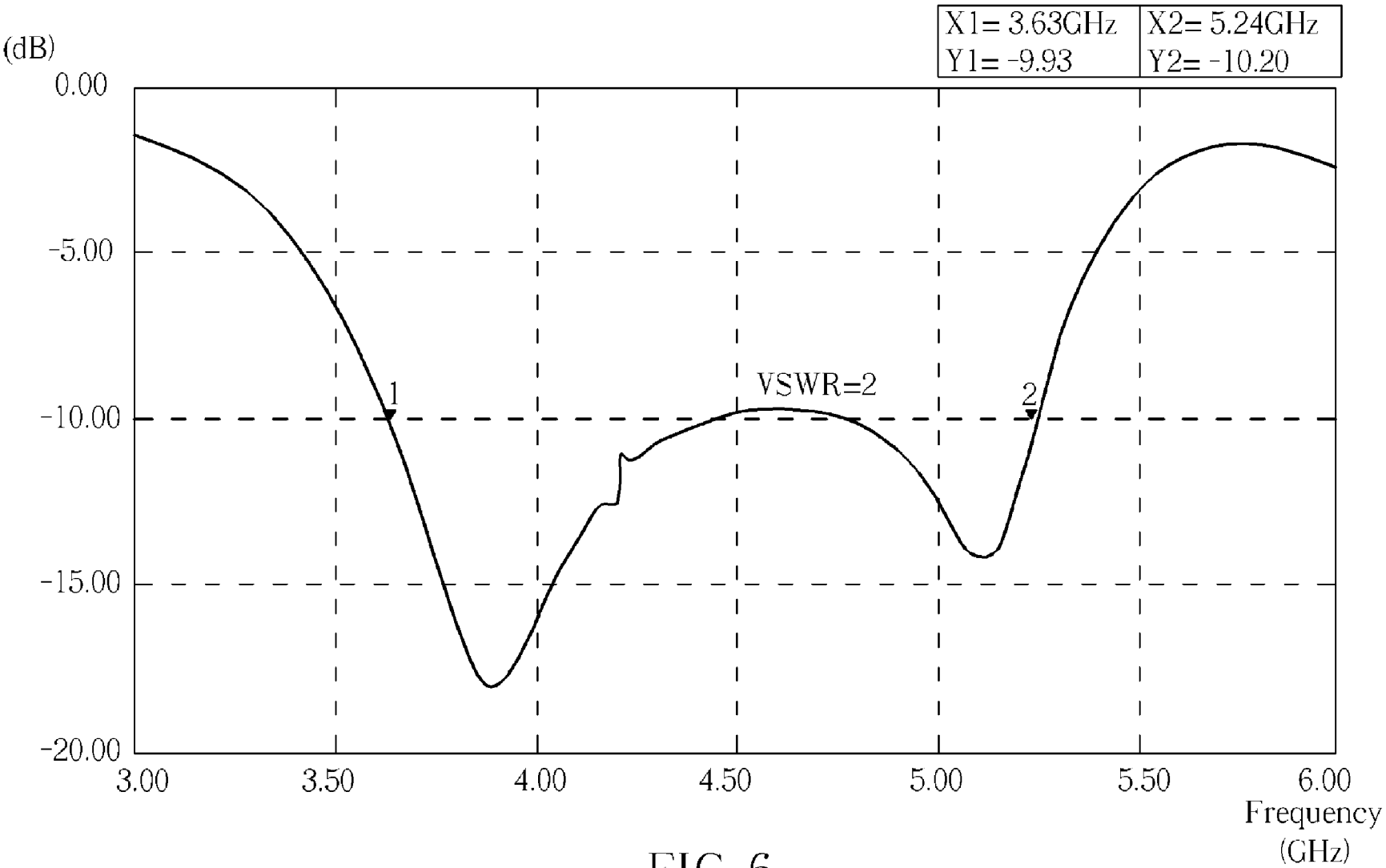
FIG. 6 is a diagram illustrating the return loss of the antenna structure shown in FIG. 3.

Please refer to FIG. 6. FIG. 6 is a diagram illustrating the return loss of the antenna structure 300 shown in FIG. 3. As shown in FIG. 6, the frequency 3.63 GHz and the return loss (−9.93 dB) of a third sign 3 and the frequency 5.24 GHz and the return loss (−10.20 dB) of a fourth sign 4 are marked. As is known from FIG. 6, the return loss falls below (−10 dB) for frequencies between 3.63 GHz and 5.24 GHz, which has a bandwidth approximately equaling 1.61 GHz (5.24 GHz−3.63 GHz=1.61 GHz). Thus an effective bandwidth percentage is substantially 1.61/4.435=36.3% ((5.25 GHz+3.63 GHz)÷2=4.435 GHz).

Figure 7:
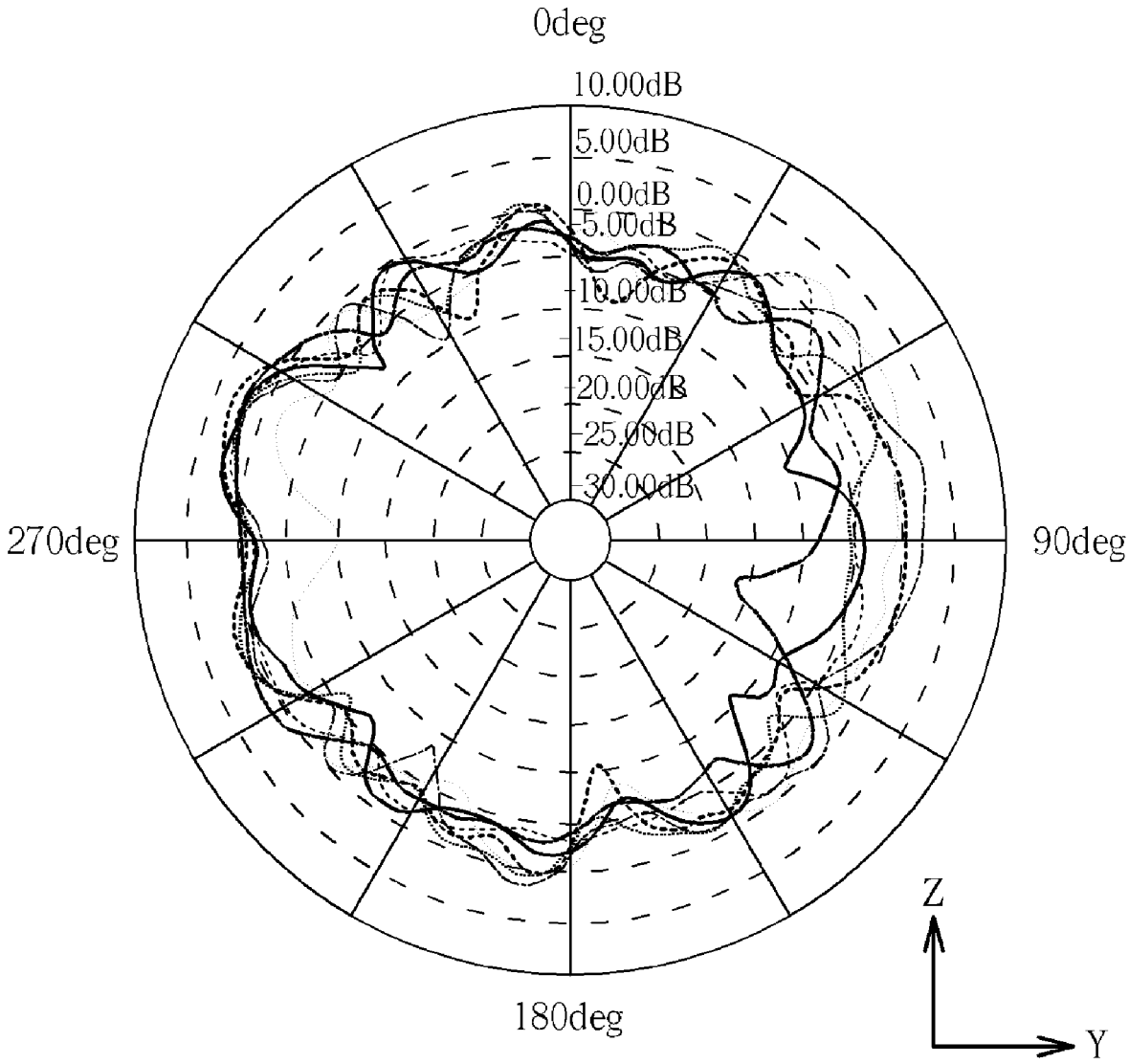
FIG. 7 is a diagram illustrating a radiation pattern of the antenna structure shown in FIG. 3.

Please refer to FIG. 7 together with FIG. 8. FIG. 7 is a diagram illustrating a radiation pattern of the antenna structure shown in FIG. 3, and FIG. 8 is a table illustrating an antenna gain of the antenna structure shown in FIG. 3. FIG. 7 shows measurement results of the antenna structure 30 in the YZ plane. As can be seen, the radiation pattern of the antenna structure 300 is similar to a circle and is an omni-directional antenna. FIG. 8 is a diagram marking out positions and values of the maximum, minimum, and average values of the antenna gain in each frequency band in FIG. 7. As can be seen, the average gains of the antenna structure 300 all fall above −2 dB in each frequency band.

Of course, the antenna structures 100 and 300 are merely one of the embodiments of the present invention, and, as is well known by persons of ordinary skill in the art, suitable variations can be applied to the antenna structures. In the following, several embodiments illustrate various modifications of the antenna structure disclosed in the present invention.

Figure 9:
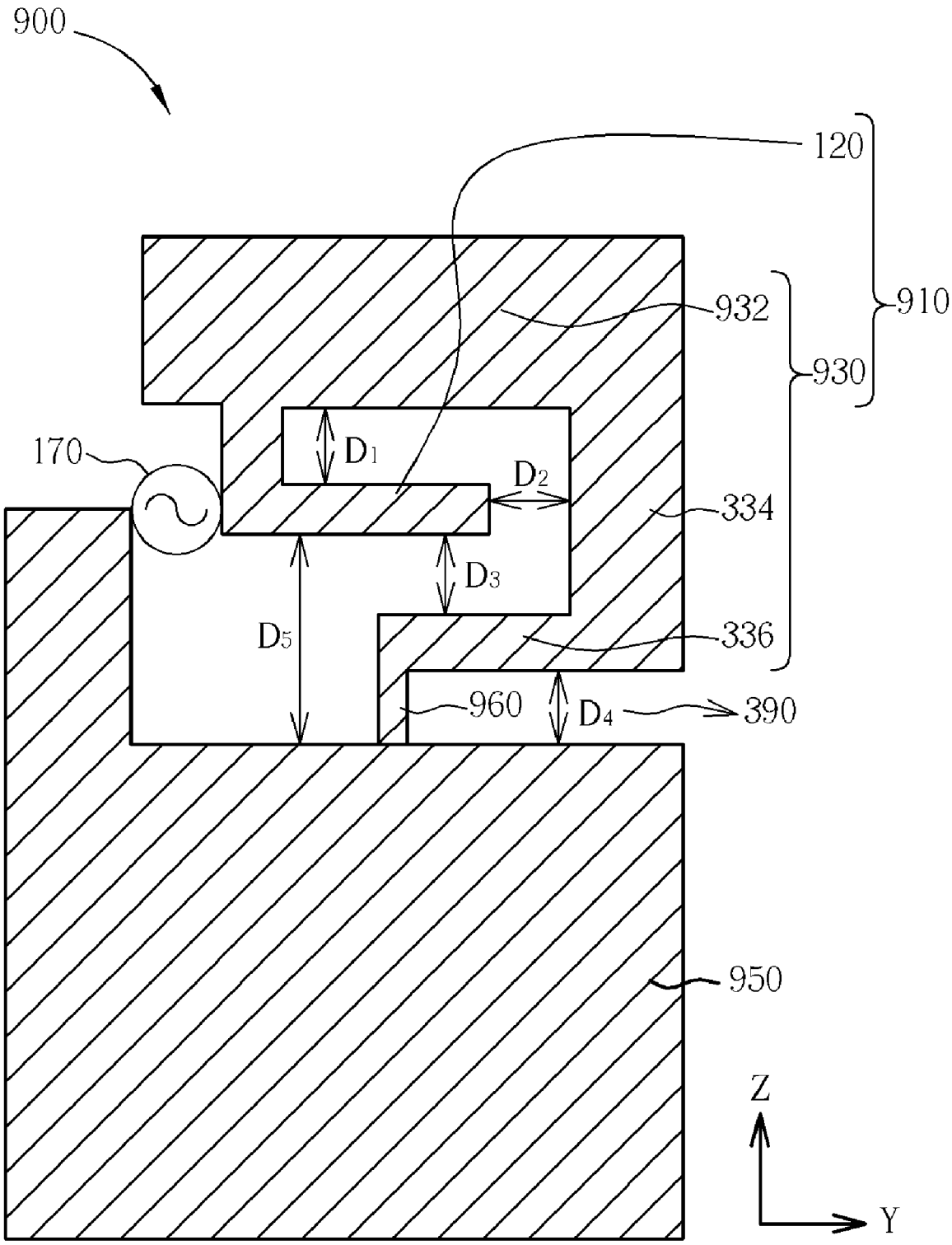
FIG. 9 is a diagram of an antenna structure according to a third embodiment of the present invention.

Please refer to FIG. 9. FIG. 9 is a diagram of an antenna structure 900 according to a third embodiment of the present invention, which is a varied embodiment of the antenna structure 300 shown in FIG. 3. In FIG. 9, the architecture of the antenna structure 900 is similar to that in FIG. 3, and the difference between them is described in the following. In FIG. 3, the antenna structure 900 includes a radiation element 910. A distance between the first radiator 120 and the third section 336 of the second radiator 330 is the same as a distance between the first radiator 120 and the grounding element 150, wherein both of the distances are $D_3$. In FIG. 9, a distance between the first radiator 120 and the third section 336 is $D_3$, but a distance between the first radiator 120 and the grounding element 950 is $D_5$, which are different from each other. In addition, an area of a first section 932 of the second radiator 930 is much greater than an area of the first section 332 of the second radiator 330 shown in FIG. 3, therefore, radiation efficiency of the second radiator 930 can be improved. Moreover, the shape and position of a short point 960 included by the antenna structure 900 are different from that of the short point 360 included by the antenna structure 300 shown in FIG. 3.

Figure 10:
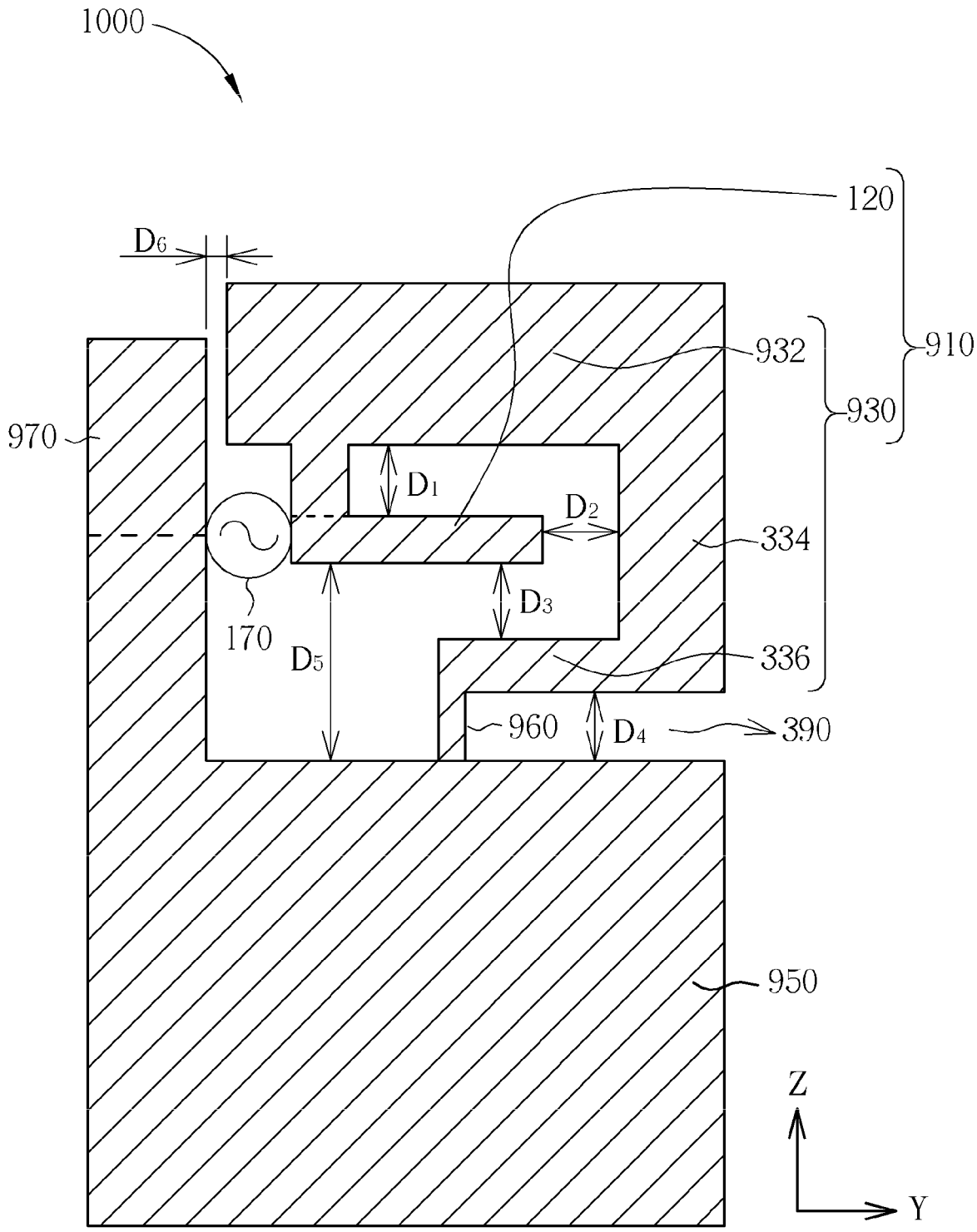
FIG. 10 is a diagram of an antenna structure according to a fourth embodiment of the present invention.

Please refer to FIG. 10. FIG. 10 is a diagram of an antenna structure 1000 according to a fourth embodiment of the present invention, which is a varied embodiment of the antenna structure 900 shown in FIG. 9. In FIG. 10, the architecture of the antenna structure 1000 is similar to that in FIG. 9, and the difference between them is that the antenna structure 1000 further includes a third radiator 970 coupled between the feeding point 170 and the grounding element 950. The third radiator 970 overlaps the second radiator 930 and is at a designated distance $D_6$ from the second radiator 930 in the second designated direction (i.e., +Y axis). Therefore, through adding the third radiator 970 into the antenna structure 1000, a third resonance mode with another frequency band can be generated to form a three-frequency antenna. In addition, the impedance matching of the antenna structure 1000 can be changed through adjusting the capacitor effect (i.e., adjusting the designated distance $D_6$) generated from the third radiator 970 and the second radiator 930. Furthermore, if the short point 960 is removed, the first radiator 120, the second radiator 930, the grounding element 950, and the feeding point 170 are disposed around along a region with an inverted S type shape. At this time, the distance between the first radiator 120 and the second radiator 930 still can be adjusted to change the impedance matching and the distance between the second radiator 930 and the third radiator 970 can also be adjusted to change impedance matching.

Of course, those skilled in the art should appreciate that the extending directions of the first radiator 120, the second radiator 930, and the third radiator 970 are not a limitation of the present invention. For example, an antenna structure, wherein extending directions of each radiator included by the antenna structure are totally opposite to the extending directions of each radiator included by the antenna structure 1000. In other words, the antenna structure is the same as a bottom-view diagram of the antenna structure 1000 (+Y axis and −Y axis are swapped), which should also belong to the scope of the present invention. At this time, the first radiator 120, the second radiator 930, the grounding element 950, and the feeding point 170 are disposed around along a region with an S type shape.

Figure 11:
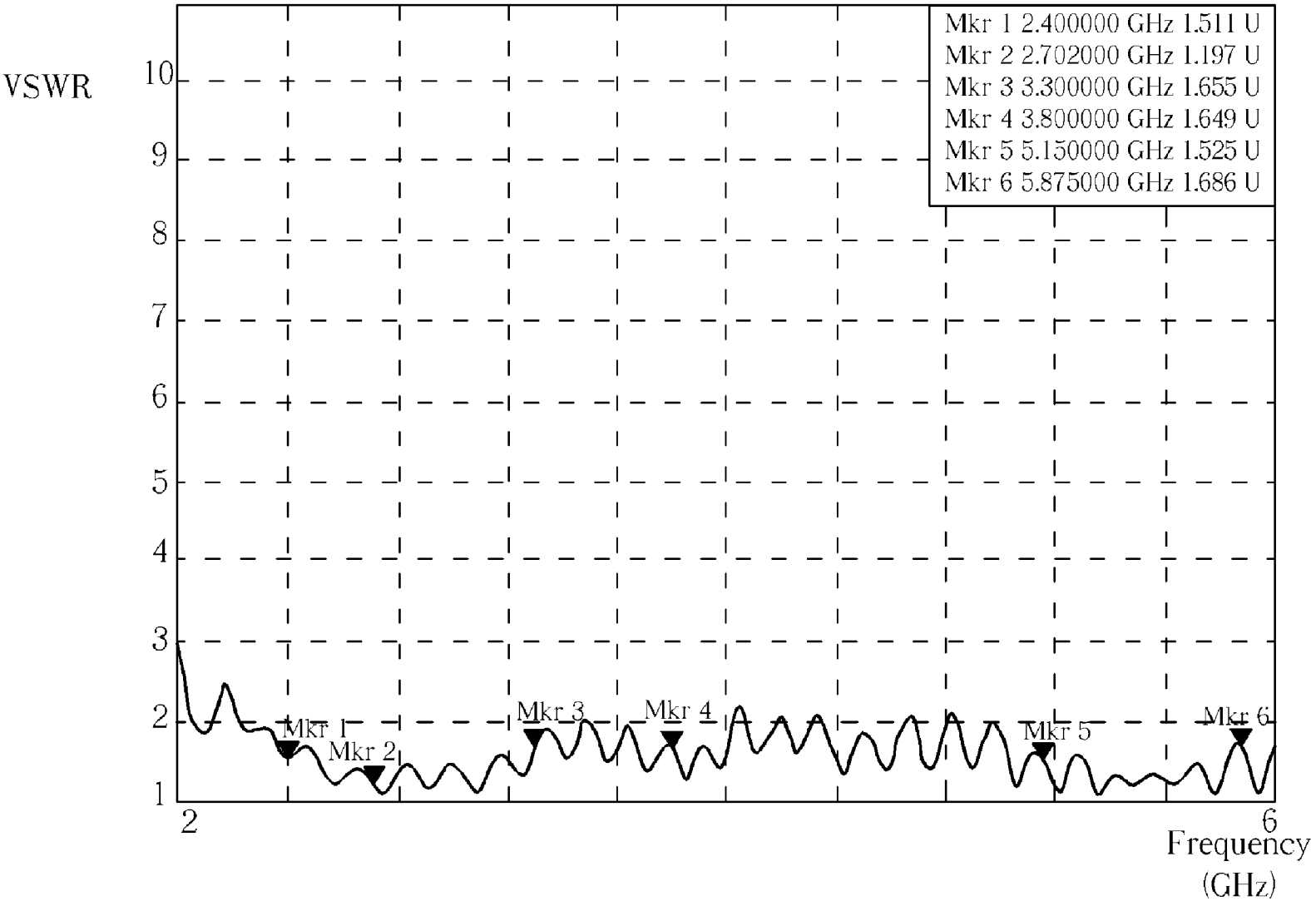
FIG. 11 is a diagram illustrating the VSWR of the antenna structure shown in FIG. 10.

Please refer to FIG. 11. FIG. 11 is a diagram illustrating the VSWR of the antenna structure 1000 shown in FIG. 10. The horizontal axis represents frequency (Hz), between 2 GHz and 6 GHz, and the vertical axis represents the VSWR. As shown in FIG. 11, the VSWR falls below 2 for frequencies between 2.4 GHz and 5.875 GHz, which has an effective bandwidth percentage substantially equaling 3.475/4.138=83.98%. Moreover, the antenna structure 1000 covers three frequency bands 2.4 GHz-2.702 GHz, 3.3 GHz-3.8 GHz and 5.15 GHz-5.875 GHz in total.

Figure 12:
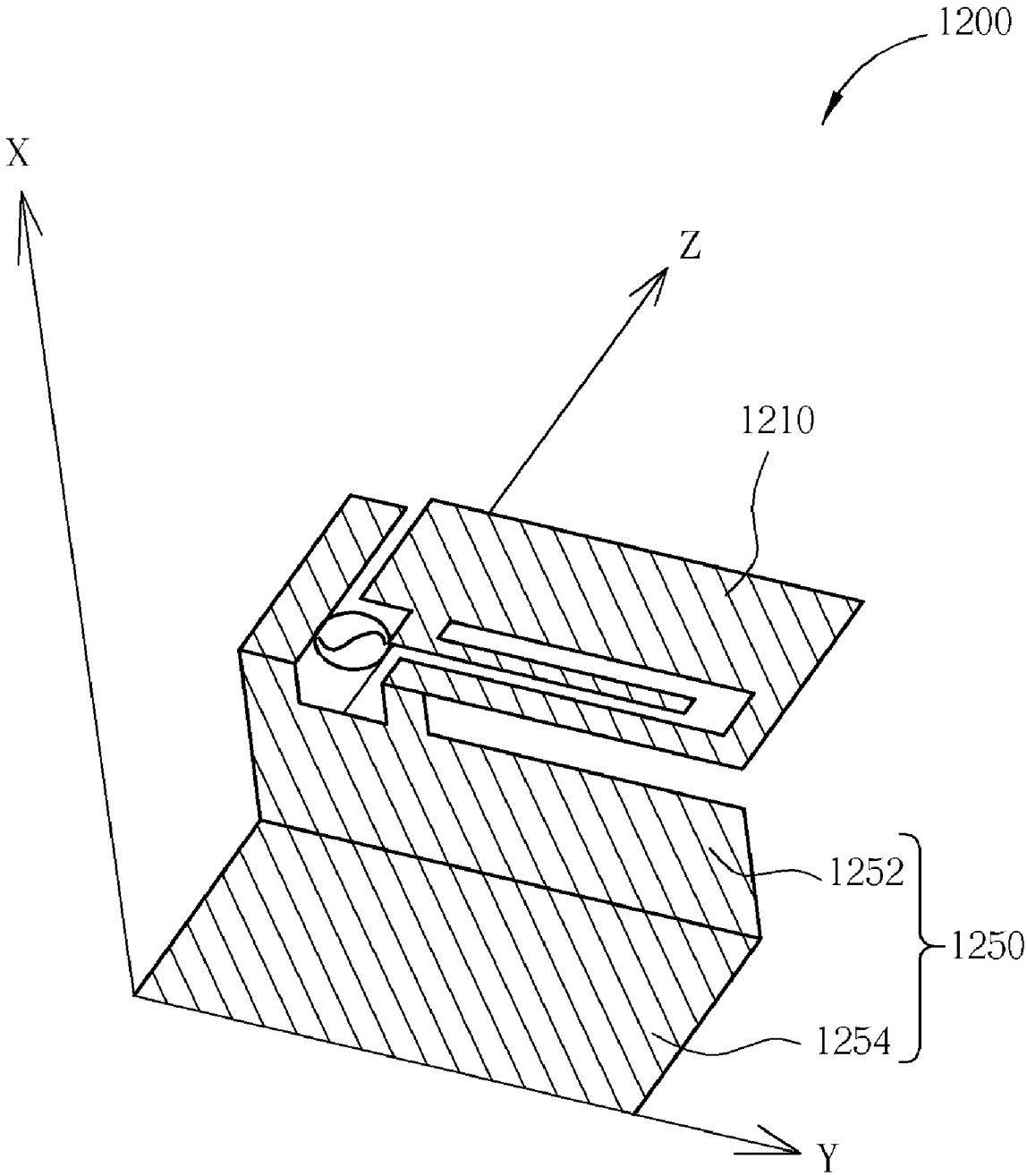
FIG. 12 is a diagram of an antenna structure according to a fifth embodiment of the present invention.

Please refer to FIG. 12. FIG. 12 is a diagram of an antenna structure 1200 according to a fifth embodiment of the present invention, which is a varied embodiment of the antenna structure 1000 shown in FIG. 10. In FIG. 12, the architecture of the antenna structure 1200 is similar to that in FIG. 10, and the difference between them is that each element of the antenna structure 1200 presents a solid form and locates on different planes. For example, a radiation element 1210 locates on the YZ plane, and a first part 1252 of a grounding element 1250 locates on the XY plane but a second part 1254 of the grounding element 1250 locates on the YZ plane. As shown in FIG. 10, each element of the antenna structure 1000 locates on the same plane. As can be known, the locating plane of each element of the antenna structure should not be considered to be limitations of the scope of the present invention. Those skilled in the art should appreciate that various modifications of the locating plane of each element of the antenna structure may be made without departing from the spirit of the present invention.

Figure 13:
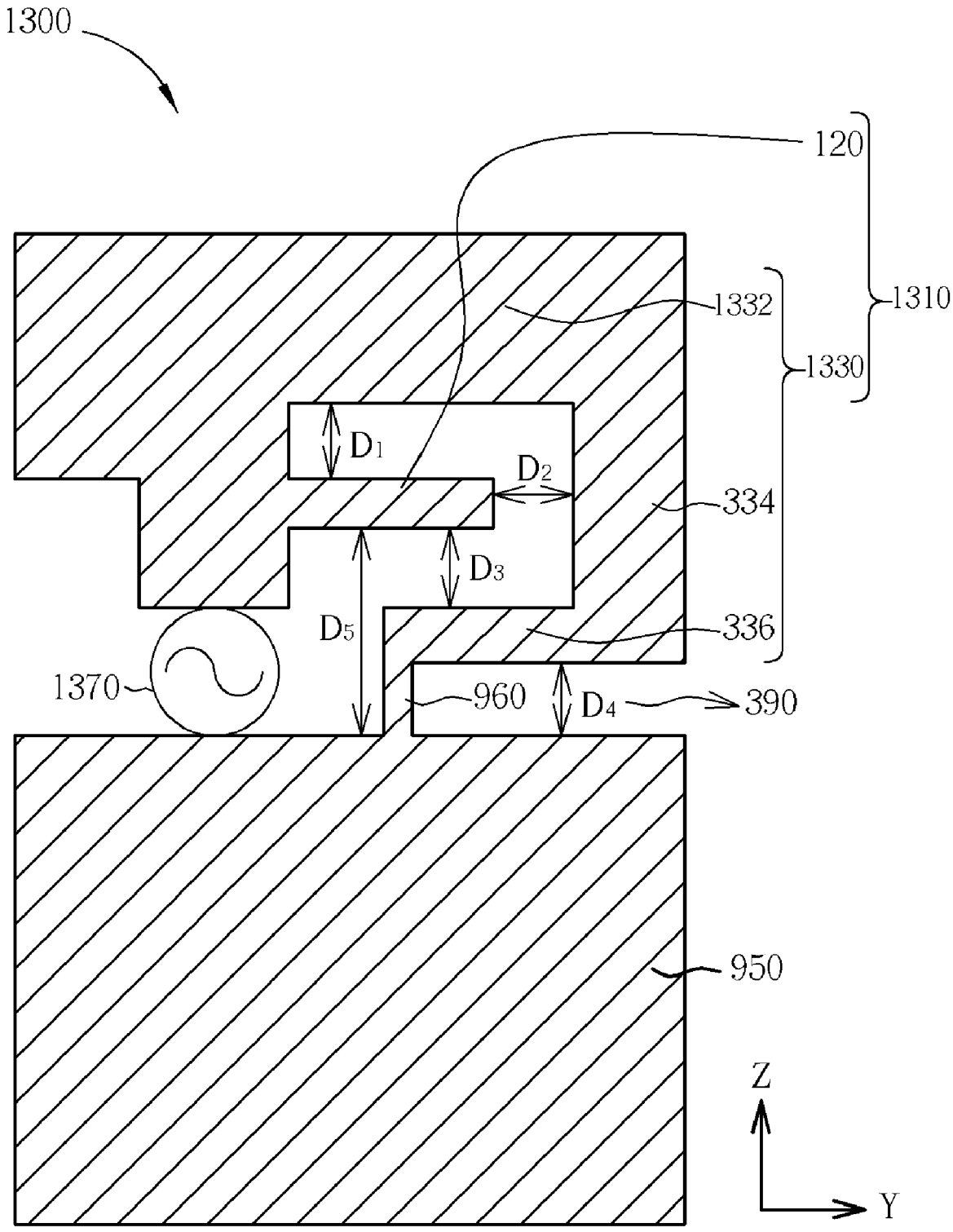
FIG. 13 is a diagram of an antenna structure according to a sixth embodiment of the present invention.

Please refer to FIG. 13. FIG. 13 is a diagram of an antenna structure 1300 according to a sixth embodiment of the present invention, which is another varied embodiment of the antenna structure 900 shown in FIG. 9. In FIG. 13, the antenna structure 1300 includes a radiation element 1310. The architecture of the antenna structure 1300 is similar to that in FIG. 9, and the difference between them is that a location of a feeding point 1370 of the antenna structure 1300 is different from that of the feeding point 170 shown in FIG. 9. In addition, an area of a first section 1332 of a second radiator 1330 shown in FIG. 13 is much greater than the area of the first section 932 of the second radiator 930 in FIG. 9, therefore, radiation efficiency of the second radiator 1330 can be improved.

From the above descriptions, the present invention provides the antenna structures 100-1300. Through disposing each section of the second radiator around the first radiator, together with the capacitor effect generated from each section of the second radiator and the first radiator at more than one location, the capacitor effect generated from the second radiator and the grounding element, the capacitor effect generated from the first radiator and the grounding element, the impedance matching of antenna can be changed. In addition, through adjusting parameters such as the designated distances $D_1$-$D_6$, a goal of increasing bandwidth of antenna can be achieved. Compared with the conventional dual-frequency antenna, the effective bandwidth of the antenna structure disclosed in the present invention is much better than that of the conventional dual-frequency antenna. Hence, the antenna structures disclosed in the present invention are suitably applied to wireless communication products requiring transmission of a large number of data. In addition, because the antenna structures disclosed in the present invention can be easily manufactured without extra cost, disclosed the antenna structures are suitable for mass production. As can be known from the VSWR and the radiation pattern, the antenna structures disclosed in the present invention have the advantages of providing omni-directional radiation patterns, small size, low cost, and covering multiple frequency bands of wireless communication systems. Therefore, the antenna structures disclosed in the present invention are suitably applied to portable device or wireless communication devices of other types.

Those skilled in the art will readily observe that numerous modifications and alterations of the device and method may be made while retaining the teachings of the invention.

What is claimed is:

1. An antenna structure, comprising:

a radiation element, having a first radiator and a second radiator, wherein the second radiator partially surrounds the first radiator and there is a predetermined distance included between the first radiator and the second radiator for matching impedance;

a grounding element;

a short point, coupled between the second radiator and the grounding element;

a feeding point, coupled between a joint point of the first radiator and the second radiator and the grounding element; and a third radiator, directly coupled to the feeding point, wherein there is a designated distance included between the third radiator and the second radiator for matching impedance.

2. The antenna structure of claim 1, wherein the short point extends from the second radiator.

3. The antenna structure of claim 1, wherein the second radiator comprises a plurality of sections, and a designated section of the plurality of sections overlaps the first radiator and is at a first designated distance from the first radiator in a designated direction, and the designated section is at a second designated distance from the grounding element in a direction opposite to the designated direction; and the designated section is parallel to the first radiator and located between the first radiator and the grounding element.

4. The antenna structure of claim 3, wherein there is a fillister formed between the designated section of the second radiator, the short point, and the grounding element.

5. The antenna structure of claim 1, wherein a length of the first radiator is approximately one-fourth of a wavelength ($\lambda/4$) of a first resonance mode generated by the antenna structure; a length of the second radiator is approximately one-fourth of a wavelength of a second resonance mode generated by the antenna structure; and a length of the third radiator is approximately one-fourth of a wavelength of a third resonance mode generated by the antenna structure.

6. The antenna structure of claim 1, wherein the radiation element and the grounding element locate on an identical plane.

7. The antenna structure of claim 1, wherein the radiation element and the grounding element locate on different planes.

8. The antenna structure of claim 7, wherein the antenna structure presents a three-dimensional form.

9. An antenna structure, comprising:

a radiation element, having a first radiator and a second radiator, wherein there is a predetermined distance included between the first radiator and the second radiator for matching impedance; the second radiator comprises a plurality of sections, and a designated section of the plurality of sections overlaps the first radiator and is at a first designated distance from the first radiator in a designated direction, and the designated section is at a second designated distance from the grounding element in a direction opposite to the designated direction; and the designated section is parallel to the first radiator and located between the first radiator and the grounding element;

a grounding element;

a short point, coupled between the second radiator and the grounding element; and a feeding point, coupled between a joint point of the first radiator and the second radiator and the grounding element;

wherein the first radiator, the second radiator, the short point, the grounding element, and the feeding point are disposed around along a sealed region.

10. The antenna structure of claim 9, wherein the sealed region is a U type.

11. The antenna structure of claim 9, wherein the short point extends from the second radiator.

12. The antenna structure of claim 9, wherein there is a fillister formed between the designated section of the second radiator, the short point, and the grounding element.

13. The antenna structure of claim 9, further comprising:

a third radiator, coupled to the feeding point, wherein there is a designated distance included between the third radiator and the second radiator for matching impedance;

a length of the first radiator is approximately one-fourth of a wavelength of a first resonance mode generated by the antenna structure;

a length of the second radiator is approximately one-fourth of a wavelength of a second resonance mode generated by the antenna structure; and a length of the third radiator is approximately one-fourth of a wavelength of a third resonance mode generated by the antenna structure.

14. The antenna structure of claim 9, wherein the radiation element and the grounding element locate on an identical plane.

15. The antenna structure of claim 9, wherein the radiation element and the grounding element locate on different planes.

16. The antenna structure of claim 15, wherein the antenna structure presents a three-dimensional form.

17. An antenna structure, comprising:

a radiation element, having a first radiator and a second radiator, wherein there is a first predetermined distance included between the first radiator and the second radiator for matching impedance;

a third radiator, wherein there is a second predetermined distance included between the third radiator and the second radiator for matching impedance;

a grounding element; and a feeding point, directly coupled between a joint point of the first radiator and the second radiator, and the third radiator and the grounding element.

18. The antenna structure of claim 17, wherein the second radiator surrounds the first radiator.

19. The antenna structure of claim 18, wherein the first radiator, the second radiator, the grounding element, and the feeding point are disposed around along a region with an S type shape.

20. An antenna structure, comprising:

a radiation element, having a first radiator and a second radiator, wherein there is a predetermined distance included between the first radiator and the second radiator for matching impedance;

a grounding element;

a short point, coupled between the second radiator and the grounding element; and a feeding point, coupled between a joint point of the first radiator and the second radiator and the grounding element;

wherein the first radiator, the second radiator, the short point, the grounding element, and the feeding point are disposed around along a sealed region;

wherein the radiation element and the grounding element locate on an identical plane.

* * * * *